United States Patent [19]

Yanabu et al.

[11] 4,434,332

[45] Feb. 28, 1984

[54] HYBRID-TYPE INTERRUPTING APPARATUS

[75] Inventors: Satoru Yanabu, Machida; Tohoru Tamagawa, Chigasaki, both of Japan

[73] Assignee: Tokyo Shibaura Denki Kabushiki Kaisha, Kanagawa, Japan

[21] Appl. No.: 292,819

[22] Filed: Aug. 14, 1981

[30] Foreign Application Priority Data

Aug. 14, 1980 [JP] Japan ..... 55-111024

[51] Int. Cl.[3] ..... H01H 33/16

[52] U.S. Cl. ..... 200/144 AP; 200/144 B; 200/148 R

[58] Field of Search ..... 200/144 B, 148 R, 144 AP

[56] References Cited

U.S. PATENT DOCUMENTS

| | | | |
|---|---|---|---|
| 3,814,882 | 6/1974 | Harrold | 200/144 B |
| 3,982,088 | 9/1976 | Porter | 200/144 B |
| 4,027,123 | 5/1977 | Ihara | 200/144 B |
| 4,087,664 | 5/1978 | Weston | 200/144 B |
| 4,204,101 | 5/1980 | Dethlefsen | 200/144 B |

*Primary Examiner*—Robert S. Macon

*Attorney, Agent, or Firm*—Oblon, Fisher, Spivak, McClelland & Maier

[57] ABSTRACT

A current interruption apparatus comprises a series-connected combination of at least one vacuum interrupter and at least one gas-blast interrupter. Each vacuum interrupter is coupled in parallel with a non-linear resistor, while each gas-blast interrupter is coupled in parallel with a capacitor. During the initial period of the recovery voltage developed upon current interruption, most of the recovery voltage is applied to the vacuum interrupter. After the instant at which the non-linear resistor represents its constant voltage characteristics, the $SF_6$ gas-blast interrupter will take the largest portion of the entire voltage increased thereafter.

5 Claims, 6 Drawing Figures

HYBRID-TYPE INTERRUPTING APPARATUS

BACKGROUND OF THE INVENTION

1. Field of the Invention

This invention relates generally to an interrupting apparatus having improved interruption capability and more particularly to an interrupting apparatus having a series-connected combination of two or more interrupting units such as a vacuum interrupter and a non-vacuum interrupter such as a sulfur hexafloride $SF_6$ gas-blast interrupter, an air blast interrupter, or an oil circuit interrupter.

2. Description of the Prior Art

At present in the power industry there is a significantly improved interruption capability with a great increase in both the rated voltage and the interrupting current of interrupters being utilized in alternating current systems; however, interrupters having still higher interrupting capabilities, that is, the capability of withstanding steep current change rates (di/dt) and steep voltage change rates (dv/dt) in the proximity to a current zero, are necessary.

On the other hand, due to the remarkable increases in power consumption, direct current transmission systems which are steadier and more economical have been put into practice and thus direct current interrupters of various types are being manufactured. Unlike alternating current interrupters, direct current interrupters require a means for establishing a current zero since direct current, as such, has no current zero. Therefore many possible methods have heretofore been considered; however, the most practical method available at the present is a system wherein a high frequency alternating current is superimposed on the direct current in order to forceably establish a current zero for successful current interruption. To apply direct current interrupters using this method to the extra high voltage class (EHV) or the ultra high voltage class (UHV) direct current transmission systems, such interrupters should be provided with high interrupting capabilities in order to withstand steep current change rates (di/dt) and steep voltage change rates (dv/dt) in the same manner as in alternating current transmission systems.

Hereinafter, a detailed description will be presented illustrating the operation of direct current interrupters employing the above discussed method for producing successful interruptions by superimposing a high frequency alternating current on the direct current in the direct current transmission system.

FIG. 1 is a schematic diagram illustrating the connection of a direct current interrupter to a direct current transmission line. In FIG. 1, it is assumed that an alternating current from an alternating current generating system (not shown) is converted into a direct current 3 by means of an alternating current to direct current converter 1. The converted direct current 3 is transmitted in the direction of the arrow through a smoothing reactor 2 connected in series with the line and through a direct current interrupter 4. The current interrupter 4 includes a vacuum interrupter 5 coupled in series with an $SF_6$ gas-blast interrupter 6 through which the direct current 3 passes. Coupled across the vacuum interrupter 5 and the $SF_6$ interrupter 6 is the parallel combination of a conventional high frequency current generator 7 (not shown in detail) and an energy absorber 9 which will be further described below.

Now assuming that an interruption of the circuit is required, the direct current interruption will be made in such a method that, first of all, the vacuum interrupter 5 and the $SF_6$ gas-blast interrupter 6 are actuated to provide sufficient clearance between their electrodes. Following this opening operation, the high frequency current generator 7 is energized to produce a high frequency alternating current 8, which is then fed into the circuit represented by the broken line, and thus will be superimposed over the direct current 3 within the interrupters 5 and 6.

The high frequency current generator 7 comprises, for example, various switching devices and a capacitor coupled in series. A charging device which functions to charge the capacitor is connected thereacross. The charging current (the high frequency current 8) flows in a direction opposite that of the direct current 3. Thus, this superimposed current serves to establish a current zero within the interrupters 5 and 6, such that current interruption can be achieved. Alternatively, the high frequency current generator may be formed by coupling a capacitor (not shown) in series between the interrupters 5 and 6 to produce a high frequency current 8 by utilizing the negative resistance characteristics of the arc produced during the interruption.

At the instant of current interruption, the smoothing reactor 2 accumulates a great amount of energy which is determined by the values of the interrupted direct current 3 and the inductance of the smoothing reactor 2. This energy is absorbed by the energy absorber 9. The energy absorber 9 can be formed by a large capacity resistor or a resistor having non-linear characteristics such as, for example a varister which primarily consists of zinc oxide. The voltage limited by this energy absorber 9, that is, the voltage represented by reference numeral 10 in FIG. 2, will be given as a recovery voltage of the interrupters 5 and 6.

FIG. 2 illustrates the waveform of the above-described phenomena. As can be seen, the interrupters 5 and 6 should withstand the steep current change rate of the high frequency current 8 represented by the dotted line, the rate of voltage rise of the recovery voltage, and the high recovery voltage 10 limited by the energy absorber 9. Moreover, after the energy stored in the smoothing reactor 2 is discharged, the interrupters 5 and 6 must withstand the voltage which still remains as developed by the direct current converter 1.

The constants for the phenomena described above are determined by the values such as the interrupted current, the voltage of the circuit in which the interrupters are used, and the voltage limited by the energy absorber; however, the performance required for the interrupters and the technology available at present are inevitably restricted, and thus the existing alternating current interrupters are not sufficient in their capabilities. For example, the steep current change rate of the high frequency current 8 shown in FIG. 2 ranges from 50 to 150 A/$\mu$ sec or higher, the rate of rise of the recovery voltage during the initial period also ranges from 5 to 10 KV/$\mu$ sec or higher, and the recovery voltage, for instance in the case of a circuit having a voltage of 250 KV, reaches a maximum of about 420 KV to 440 KV.

When such severe duty cycles are compared with the interruption performance of vacuum and $SF_6$ interrupters, which are considered to be the most superior interrupters available at present, it can be seen that the highest one among such vacuum interrupters would range from 150 A/μ sec up to 300 A/μ sec in the steep current change rate, and may withstand as high as 50 KV/μ sec in the rate of voltage rise. However, the ratings of vacuum interrupters being manufactured for use in the present alternating current systems range only from 72 KV to approximate 125 KV, and moreover the most significant disadvantage is that there is the danger of the occurrence of reignition since countermeasures to prevent such occurrence have not been perfected, and in the case of the direct current systems, if reignition has occurred, it is impossible to provide re-interruption.

The characteristics of typical $SF_6$ gas-blast interrupters in the proximity of a current zero generally range from 20 A/μ sec to 30 A/μ sec, or at the highest up to 50 A/μ sec, and 8 KV/μ sec for the maximum dv/dt.

These values represent the highest possible interrupting capability for their actual duty cycles. Thus it is impossible to impose duty cycles on these interrupters in excess of the above described values. Obviously, then, there is a great difficulty in providing either type of interrupters for use in the direct current transmission circuitry with satisfactory performance. On the other hand, the interrupting capabilities required for interrupters in alternating current circuitry are considered to be at least in the range of 40 KA to 50 KA even for those systems having a rating of 500 KVA, and such needs are anticipated to significantly increase in the future. Moreover, due to the short-line fault interruption or pull-out interruption, higher performance interrupters are presently increasingly required. The highest values in performance under these conditions can be represented such that in the case of a 275 KV, 50 HZ system, for example, when the interruption current is in the range of 63 KA (r.m.s), the rate of current fall (di/dt) reaches as high as 30 A/μ sec, and the rate of voltage rise reaches up to 10 KV/μ sec. The conditions are considered to have already exceeded the limits of interruption capability of even $SF_6$ gas-blast interrupters that are regarded as the most suitable interrupters for use in the EHV or UHV systems.

For such applications, a series connected combination of a vacuum interrupter and a non-vacuum interrupter, such as an $SF_6$ gas-blast interrupter, has been utilized. This device, referred to as a hybrid-type interrupter, is desirable because it combines the high current interruption capability of a vacuum interrupter with the superior voltage withstanding capacity of an $SF_6$ gas-blast interrupter. However, a mere series-connection of both types of interrupters cannot make effective use of their advantages. Therefore, hybrid-type interrupting devices are needed wherein, during the period from a current zero to the rise of the recovery voltage, vacuum interrupters serve to control the largest share of the recovery voltage and wherein $SF_6$ gas-blast interrupters serve to control the largest share of the increased recovery voltage occurring thereafter.

SUMMARY OF THE INVENTION

Accordingly, one object of this invention is to provide a novel interrupting apparatus having a hybrid combination of vacuum and $SF_6$ gas-blast interrupters to effectively utilize their advantages in order to solve such problems which are likely to occure in the future as discussed above.

Briefly, in accordance with one aspect of this invention, an interrupting apparatus is provided which includes a series-connected combination of at least one vacuum interrupter and at least one gas-blast interrupter. A non-linear resistor is connected in parallel with the vacuum interrupter and a capacitor is connected in parallel with the gas-blast interrupter.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 3:
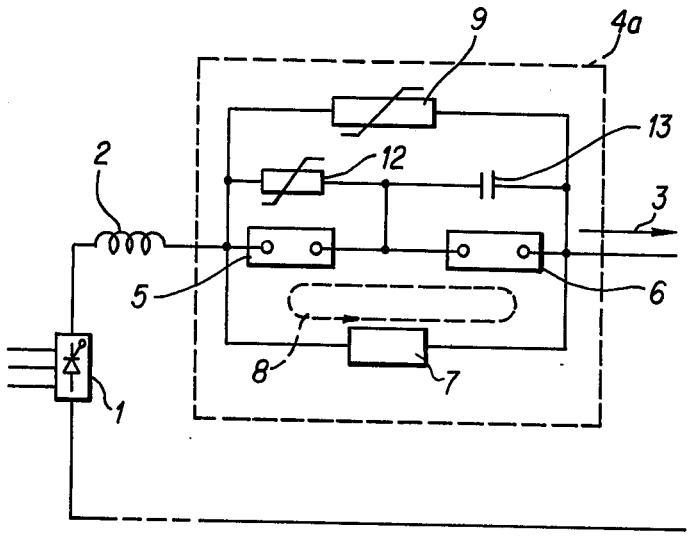
FIG. 3 is a circuit diagram illustrating one embodiment of an interrupting apparatus according to the present invention.

Referring now to the drawings, wherein like reference numerals designate identical or corresponding parts throughout the several views, and more particularly to FIG. 3 thereof, a first preferred embodiment of the present invention is illustrated and in particular the preferred embodiment is illustrated as a direct current interrupter.

Figure 1:
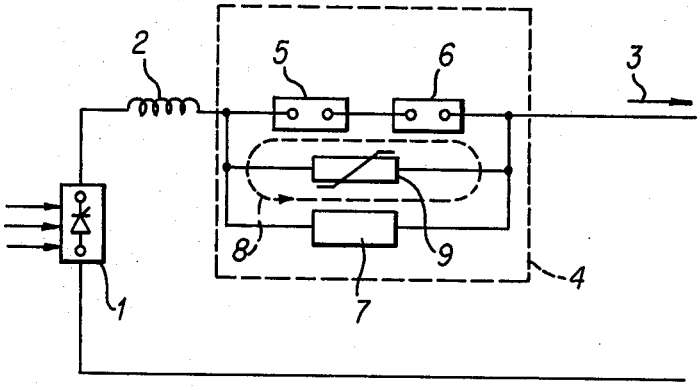
FIG. 1 PRIOR ART
FIG. 1 is a circuit diagram illustrating the principles of a conventional direct current interrupting apparatus.
Figure 2:
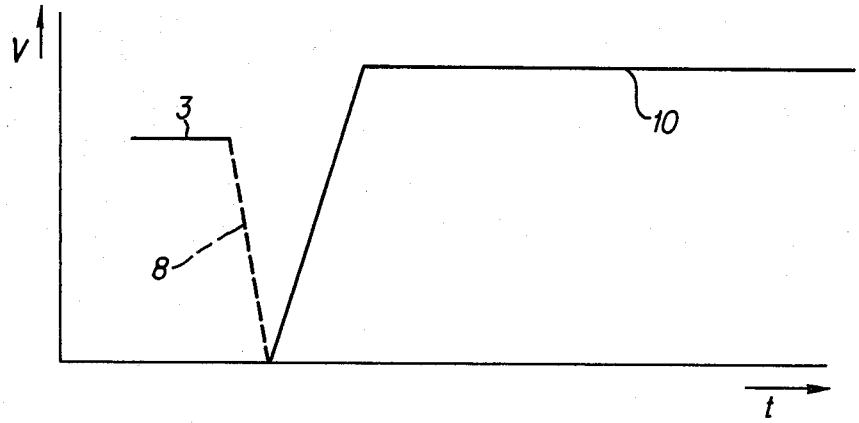
FIG. 2 PRIOR ART
FIG. 2 is a waveform diagram illustrating the recovery voltage in the circuit shown in FIG. 1.

In FIG. 3, the direct current interrupter 4*a* is illustrated as including the parallel combination of a vacuum interrupter 5 and a non-linear resistor 12 coupled in series with the parallel combination of an $SF_6$ gas-blast interrupter and a capacitor 13. An energy absorber 9 and a high frequency current generator 7 are coupled in parallel between the input and the output of the interrupter 4*a* in a manner similar to that discussed above with respect to the prior art device shown in FIG. 1. The process of current interruption and the voltage applied across both the entire interrupter 4*a* and the respective interrupters 5 and 6 in the circuitry according to this embodiment of the invention are identical to those when described in accordance with FIGS. 1 and 2.

Figure 4:
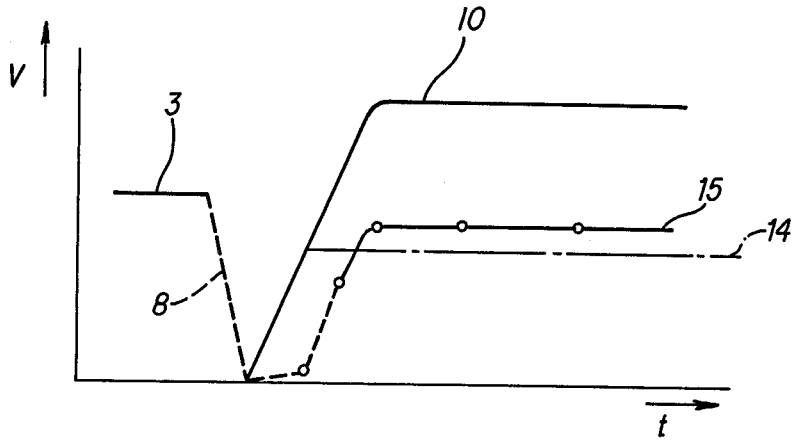
FIG. 4 is waveform diagram illustrating the recovery voltage in the circuit shown in FIG. 3.

Although the voltage 10 is applied across the entire interrupter 4*a* as shown in FIG. 4, during the initial period of the voltage rise, the capacitor 13 is not charged by virtue of the non-linear resistor 12, such that the entire voltage in this instance is applied across the vacuum interrupter 5, and thus no voltage appears across the $SF_6$ gas-blast interrupter 6. However, when the entire voltage is increased sufficiently to cause the non-linear resistor 12 to exhibit the constant voltage characteristics, that is, at the instant when the non-linear resistor 12 initiates a flow of larger current against a greater increase in the entire voltage, then the capacitor 13 connected across the $SF_6$ gas-blast interrupter 6 will be charged. As a result, the residual voltage obtained by subtracting the voltage limited by the non-linear resistor 12 from the entire voltage will be taken as the share of the voltage 10 which appears across the $SF_6$ gas-blast interrupter 6. This voltage can ideally be determined by virtue of the superior non-linearity in resitivity derived from the prime constituent of zinc oxide in the non-linear resistor 12.

FIG. 4 shows such phenomena in a graphical presentation, that is, during the initial period of the recovery voltage, the most voltage thereof is applied to the vaccum interrupter 5, and after the instant at which the non-linear resistor 12 shows its constant voltage characteristics, the $SF_6$ gas interrupter 6 will take a share in the entire voltage increased thereafter.

After the entire voltage has reached its highest value, a constant voltage 14 limited by the non-linear resistor 12 will appear across the vacuum interrupter 5. The residual voltage 15, which is obtained by subtracting the voltage 14 which is taken as the share of the vaccum interrupter 5 from the entire voltage 10, appears across the $SF_6$ gas blast interrupter 6.

The ratio of the voltage shares taken by the respective interrupters can be selectively determined depending upon the voltage limited by the non-linear resistor 12 connected across the vacuum interrupter 5. As described above, when the entire voltage is shared by the respective interrupters, effective use can be made of the advantages in the interruption characteristics of both types of interrupters. For example, the vacuum interrupter 5 can withstand a steep current ratio ranging from 50 A/$\mu$ sec to 150 A/$\mu$ sec, and also can withstand a rate of voltage rise ranging from 10 Kv/$\mu$ sec to 50 Kv/$\mu$ sec. However, manufacturing vacuum interrupters for use in EHV or UHV systems has been considered difficult in light of the present technology in production of such interrupters. This is caused by the fact that there are structural problems and also because of the danger of the occurrence of re-ignition for the vacuum interrupters.

On the other hand $SF_6$ gas-blast interrupters operate by blasting $SF_6$ gas against the arc to be quenched upon interruption, so that values of the rate of current fall (di/dt) and the rate of voltage rise (dv/dt) in the proximity to the current zero determine whether the interruption will be successfully achieved. Thus, it is impossible for an $SF_6$ gas interrupter to make a successful interruption with duty cycles having excessively great values in the rate of current fall (di/dt), and the rate of voltage rise (dv/dt).

However, according to the present invention, in the proximity of the current zero, the vacuum interrupter 5 will cause a current interruption by effectively utilizing its superior characteristics, while in the voltage region in which the vacuum interrupter 5 is susceptible to problems, the $SF_6$ gas-blast interrupter 6 will take a share of the voltage.

Although the example shown in FIG. 4 illustrates the ratio of voltage shares as being approximately equal, this ratio may be varied depending upon the particular characteristics of the vacuum and $SF_6$ gas-blast interrupters to be utilized. If necessary, two or more series-connected vacuum interrupters or two or more series-connected $SF_6$ gas-blast interrupters can also be utilized in place of such respective interrupters as in the above-described interrupting apparatus. In this case each of the vacuum interrupters should be connected in parallel with a non-linear resistor, while each respective $SF_6$ gas-blast interrupter should be connected in parallel with a capacitor, and in some cases, conventional resistors may additionally be connected in parallel with such capacitors respectively.

The embodiment of the present invention described above can also be utilized for interrupting alternating currents. In this case, even when the rate of current fall (di/dt) and the rate of voltage rise (dv/dt) become extremely large due to the larger short circuit current, such large rates can be handled by the vacuum interrupters and the higher recovery voltage thereafter can be shared by the respective interrupters depending upon their individual capabilities. However, when the interrupter is utilized with alternating currents, the high frequency generator 7 and the energy absorber 9 shown in FIG. 3 are not required.

Figure 5:
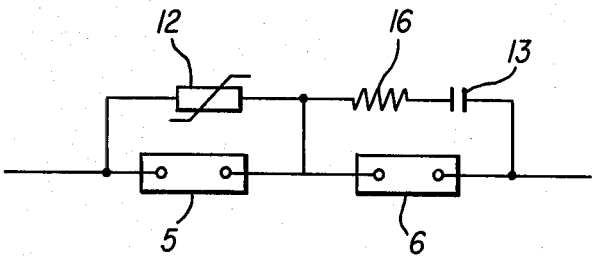
FIG. 5 is a circuit diagram illustrating another embodiment of an interrupting apparatus according to the present invention.

FIG. 5 illustrates another preferred embodiment according to the present invention, wherein an $SF_6$ gas-blast interrupter 6 is connected in parallel with the series combination of a capacitor 13 and a resistor 16. The remaining portions of the interrupter according to this embodiment are the same as described above with respect to the embodiment of the subject invention shown in FIG. 3.

For the $SF_6$ gas-blast interrupter 6 connected as described above in the embodiment of the subject invention of FIG. 3, the rate of voltage rise in a fraction of the period, such as 5 to 10 $\mu$s, immediately after the current interruption determines whether the interruption will be successfully made; however, in some cases, depending upon the characteristics of the non-linear resistor 12 connected in parallel with the vacuum interrupter 5, the entire voltage will rise so steeply that the rate of voltage rise within this fraction of the period can become too great to ensure a successful interruption. In such cases, if the $SF_6$ gas-blast interrupter 6 is connected in parallel with the series-connected combination of the resistor 16 and the capacitor 13 as in the embodiment of the present invention shown in FIG. 5, the rise rate of the entire voltage can be suppressed by virtue of the resistor 16 connected in series with the capacitor 13, and thus the $SF_6$ gas-blast interrupter can achieve a successful interruption.

Figure 6:
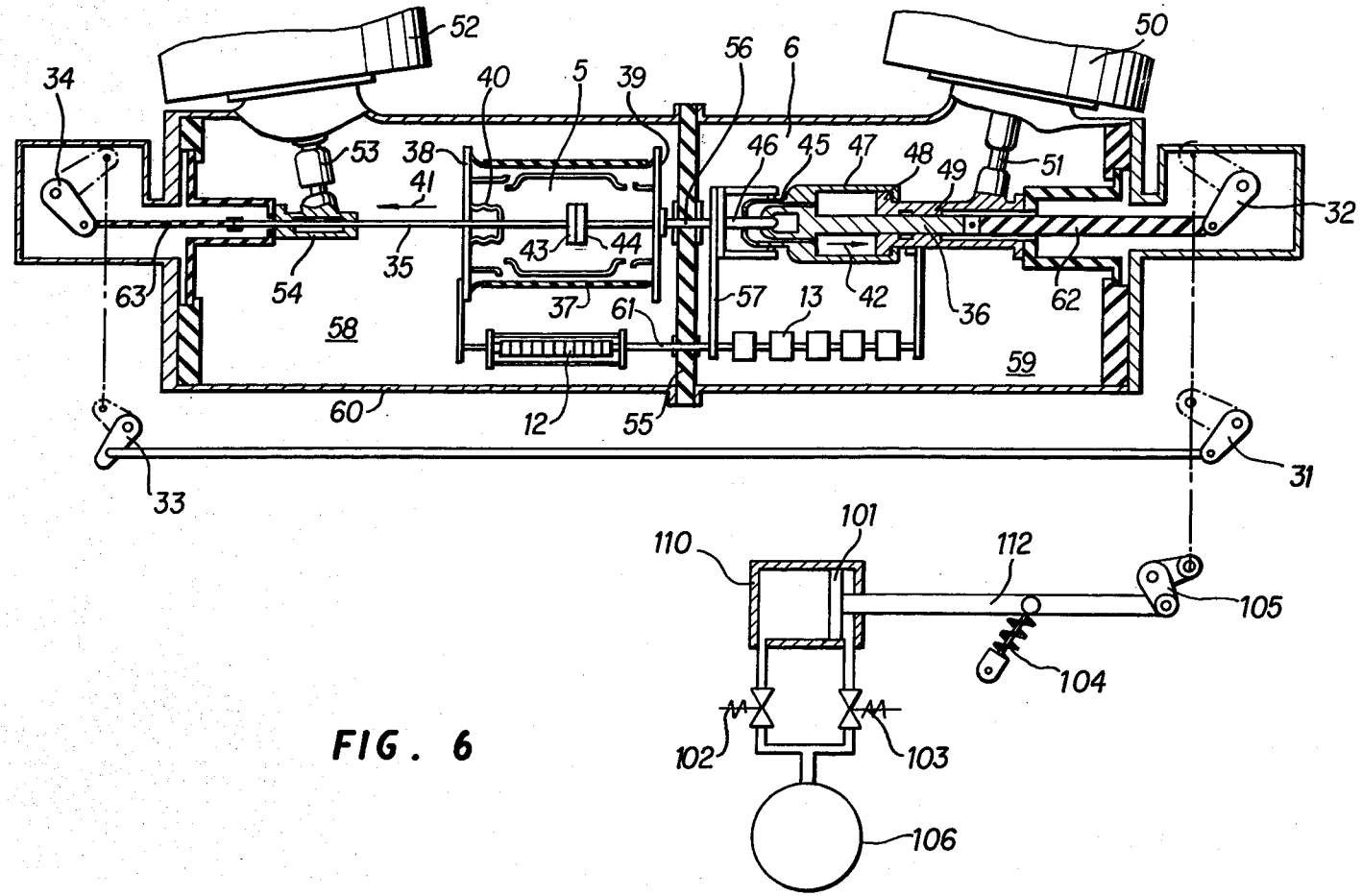
FIG. 6 is a more detailed structure diagram of an interrupting apparatus according to the present invention.

FIG. 6 is a cross-sectional view illustrating the interrupting units in more detail according to the embodiment of the present invention shown in FIG. 3. In FIG. 6, the interrupting unit consisting of the vacuum interrupter 5, the non-linear resistor 12 coupled in parallel with the vacuum interrupter, the $SF_6$ gas interrupter 6, and the capacitor 13 coupled in parallel therewith is contained in a single vessel 60. The high frequency current generator 7 and the energy absorber 9 are located external to the vessel 60 and thus are not illustrated.

In FIG. 6, the interrupting units 5 and 6 are shown in a closed position, and a piston 101 linked with a crank 105 via a connecting rod 112 communicates through a closing electromagnetic valve 102 and an interrupting electromagnetic valve 103 to a compressed air container 106. The electromagnetic valves 102 and 103 are both cross-valves which function to send compressed air from the container 106 into a cylinder 110 surrounding the piston 101 when energized; however, when de-energized, they function to discharge air to the atmosphere. The container 106 reserves at all times enough air pressure to actuate the interrupters 5 and 6.

Now, assuming that when the vacuum interrupter 5 and the $SF_6$ gas-blast interrupter 6, shown in a closed position, are to be actuated into an opened position, the interrupting electromagnetic valve 103 is first energized, thereby sending compressed air into the cylinder 110 to actuate the piston 101 toward the left as is illustrated. The piston 101, in turn, transmits this movement by means of the connecting rod 112 and the crank 105 to the interrupting unit. In this case, a toggle spring 104 will rotate counterclockwise from the position illustrated. After the spring 104 has passed over its dead point, it will apply a force in the opening direction to ensure that the open position is achieved. Consequently, linkages 31, 32, 33 and 34 are actuated, and in turn, both operating rods such as a rod 35 of the vacuum interrupter 5 and a rod 36 of the $SF_6$ gas-blast interrupter 6 are actuated through electrically insulated connecting rods 63 and 62, respectively, thereby opening the interrupters 5 and 6.

As shown in FIG. 6, the vacuum interruper 5 has an airtight chamber maintained completely airtight and vacuum-tight by means of a bellows 40 mounted on an end plate 38 which is one of two metallic end plates 38 and 39 supporting an insulating tube 37. The movement in the direction of the arrow 41 of the operating rod 35 separates a movable electrode 43 from a stationary electrode 44 of the vacuum interrupter 5, and thus an arc will be developed therebetween.

For the $SF_6$ gas-blast interrupter 6, the movement of the operating rod 36 in the direction of the arrow 42 separates a movable electrode 45 from a stationary electrode 46 and thus an arc will be developed therebetween. Simultaneously, a puffer cylinder 47 operatively connected with the movable electrode 45 will be actuated. A piston 48 within the puffer cylinder 47 is coupled, together with a current collecting means 49, to a line conductor 51 within a bushing 50. The movement of the cylinder 47 in the direction of the arrow 42 compresses $SF_6$ gas contained in a puffer chamber within the cylinder 47, and thus functions to blast and quench the arc developed between the stationary electrode 46 and the movable electrode 45.

In the closed position of the interrupters 5 and 6 shown in FIG. 6, the current 3 (not shown) to be interrupted flows from a line conductor 53 within a bushing 52 through a current collecting member 54 and the operating rod 35, and further through the pair of electrodes 43 and 44 of the vacuum interrupter 5 to a connecting rod 56 disposed in and penetrating through an electrically insulated spacer 55 supporting the vacuum interrupter 5. Further, the current 3 flows from the stationary electrode 46 of the $SF_6$ gas-blast interrupter 6 to the movable electrode 45, and then through the operating rod 36 to the line conductor 51 within the other bushing 50.

As above described, operation of the mechanism can produce an arc between the electrodes 43 and 44 of the vacuum interrupter 5 and also between the electrodes 45 and 46 of the $SF_6$ gas-blast interrupter 6.

In the embodiment shown in FIG. 3, current interruption can be achieved with the above described device in a direct current interrupter operation. When utilized as an alternating current interrupter, current interruption can be achieved in synchronism with the current zero of the alternating current.

Hereinbefore, the interrupting operation has been described; however, the current making operation can be achieved in the reverse manner to that above described, for instance upon energizing the valve 102, the piston 101 moves toward the right and allows the interrupter to be closed as shown in FIG. 6.

In FIG. 6, one end of the non-linear resistor 12 is electrically connected to the metallic end plate 38 of the vacuum interrupter 5, and the other end of the resistor 12 is connected to one end of the capacitor 12 via a connecting rod 61 supported by the spacers 55 and also penetrating therethrough. The other end of the capacitor 13 is electrically connected to metallic members which maintain identical potential to the movable electrode 45 of the $SF_6$ gas-blast interrupter 6. A conductor 57 is electrically attached to the juncture between the non-linear resistor 12 and the capacitor 13. The conductor 57 is utilized to electrically connect the juncture to the connecting rod 56 which completes the electrical connection between the vacuum interrupter 5 and the $SF_6$ gas-blast interrupter 6.

An electrically insulating gas, such as $SF_6$ gas, is contained within two chambers 58 and 59 partitioned by the electrically insulating spacer 55 within the vessel 60 which accommondates both interrupters 5 and 6. Since the bellows 40 of the vacuum interrupter 5 cannot withstand external pressure, the pressure in the chamber 58 is maintained slightly lower than that in the chamber 59, for instance, ranging from 2 to 3 $kg/cm^2$. This requires the connecting rods 56 and 61 and the insulating spacer 55 to be so fabricated as to ensure a completely airtight relationship. Moreover, the current collecting members 54 and 49 are supported against the vessel 60 with intervening electrical insulators.

As above described, since the $SF_6$ gas-blast interrupter 6 and the vacuum interrupter 5 are protected by the insulating spacer 55, the arc developed within the $SF_6$ gas-blast interrupter 6 cannot enter into the vacuum interrupter side. Therefore, the vacuum interrupter 5 is protected so that its voltage withstanding characteristics do not deteriorate.

According to the above-described interrupting apparatus, the recovery voltage is applied to the vacuum interrupter during the initial period depending upon the characteristics of non-linear resistor, and after the instant at which the non-linear resistor has represented its constant voltage characteristics, the increase in the entire voltage thereafter is taken as the voltage share of the $SF_6$ gas-blast interrupter, so that it is possible to provide an interrupting apparatus that can make effective use of the advantages of both types of interrupters.

It should be understood that various modifications and variations are possible in light of the above teachings. For example, in each of the preferred embodiments described above, the $SF_6$ gas-blast interrupter may be replaced by an air circuit-type interrupter or an oil circuit-type interrupter with similar favorable results.

Obviously, numerous (additional) modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A current interrupting apparatus, comprising:

at least one vacuum interrupter means;

at least one gas-blast interrupter means coupled in series with said at least one vacuum interrupter means;

non-linear resistor means coupled in parallel with said vacuum interrupter means;

impedance means coupled in parallel with said at least one gas blast interrupter means;

high frequency current generator means coupled in parallel with the series combination of said at least one vacuum interrupter means and said at least one gas-blast interrupter means; and energy absorber means coupled in parallel with the series combination of said at least one vacuum interrupter means of said at least one gas-blast interrupter means.

2. The current interrupting apparatus as recited in claim 1, wherein:

said non-linear resistor means includes at least zinc oxide.

3. The current interrupting apparatus as recited in claim 1, wherein:

said impedence means includes a capacitor.

4. The current interrupting apparatus as recited in claim 1, wherein:

said independence means includes a resistor coupled in series with a capacitor.

5. A current interrupting apparatus, comprising:

a housing filled with an insulating gas and having a first portion and a second portion partitioned therewith;

vacuum interrupter means disposed in a gas-insulated relationship within said first portion of said housing;

gas-blast interrupter means disposed in a gas-insulated relationship within said second portion of said housing with the pressure of said insulating gas filling said first portion of said housing being lower than the pressure of said insulating gas filling said second portion of said housing;

non-linear resistor means coupled in parallel with said vacuum interrupter means; and capacitor means coupled in parallel with said gas-blast interrupter means.

* * * * *